US010765290B2

(12) United States Patent
Kalitowski

(10) Patent No.: US 10,765,290 B2
(45) Date of Patent: Sep. 8, 2020

(54) FLOOR CLEANING DEVICE

(71) Applicant: David Kalitowski, San Marcos, CA (US)

(72) Inventor: David Kalitowski, San Marcos, CA (US)

( * ) Notice: Subject to any disclaimer, the term of this patent is extended or adjusted under 35 U.S.C. 154(b) by 61 days.

(21) Appl. No.: 16/033,782

(22) Filed: Jul. 12, 2018

(65) Prior Publication Data

US 2020/0015652 A1 Jan. 16, 2020

(51) Int. Cl.

| | |
|---|---|
| ***A47L 13/12*** | (2006.01) |
| ***A47L 13/256*** | (2006.01) |
| ***A47L 13/44*** | (2006.01) |
| ***A47L 13/20*** | (2006.01) |

(52) U.S. Cl.

CPC ..... *A47L 13/256* (2013.01); *A47L 13/20* (2013.01); *A47L 13/44* (2013.01); *A47L 13/12* (2013.01)

(58) Field of Classification Search

CPC ..... A47L 13/12; A47L 13/22; A47L 13/20; A47L 13/256

See application file for complete search history.

(56) References Cited

U.S. PATENT DOCUMENTS 3,877,103 A * 4/1975 Nash ..... A47K 10/14 15/147.1
5,410,772 A 5/1995 Lewis
5,426,809 A * 6/1995 Muta ..... A47L 13/254 15/228
5,522,110 A * 6/1996 Borofsky ..... A47L 13/12 15/115
5,584,091 A 12/1996 Borofsky
5,815,878 A * 10/1998 Murakami ..... A47L 13/46 15/231
5,876,141 A * 3/1999 Hsu ..... A47L 13/254 15/144.2
5,903,948 A * 5/1999 Williams ..... A46B 5/00 15/115
6,098,239 A * 8/2000 Vosbikian ..... A47L 13/254 15/228
6,202,250 B1 * 3/2001 Kenmochi ..... A47L 13/20 15/209.1
6,305,046 B1 * 10/2001 Kingry ..... A47L 13/256 15/228
6,842,936 B2 * 1/2005 Policicchio ..... A47L 13/16 15/104.94
7,127,772 B2 10/2006 Dingert
7,448,106 B2 * 11/2008 Aiyar ..... A46B 11/0017 15/230
D644,386 S 8/2011 Tawara
(Continued)

*Primary Examiner* — Michael D Jennings

(57) ABSTRACT

A floor cleaning device for more efficient cleaning of floors includes a rod and a plate. The plate is pivotally coupled to a lower end of the rod. A ridge is coupled to and extends from a bottom face of the plate. The ridge extends between opposing side edges of the plate. A plurality of couplers is coupled to the plate. Each coupler is configured to couple to a cloth proximate to a perimeter of the cloth so that the cloth is removably coupled to the plate. The cloth is positioned over the ridge and the bottom face of the plate. A user is positioned to grasp the rod and urge the cloth across a surface to clean the surface. Corner edges of the ridge provide increased contact between the cloth and the surface for more efficient cleaning of the surface.

1 Claim, 3 Drawing Sheets

(56) References Cited

U.S. PATENT DOCUMENTS

| | | | | |
|---|---|---|---|---|
| 8,166,597 | B2 * | 5/2012 | Levitt | A47L 13/256 15/118 |
| 8,464,387 | B1 * | 6/2013 | Cohen | B60S 3/045 15/105 |
| 9,408,518 | B2 * | 8/2016 | Bradbury | A47L 13/44 |
| 9,743,819 | B2 * | 8/2017 | Davidshofer | A47L 13/22 |
| 10,045,678 | B2 * | 8/2018 | Hay et al. | |
| 10,285,558 | B2 * | 5/2019 | O'Shea | A47L 13/256 |
| 2004/0045126 | A1 * | 3/2004 | Parker | A47L 5/28 15/403 |
| 2004/0068817 | A1 * | 4/2004 | Policicchio | A47L 13/16 15/228 |
| 2006/0288508 | A1 * | 12/2006 | Knopow | A47L 13/24 15/144.1 |
| 2014/0026344 | A1 * | 1/2014 | Bradbury | A47L 13/44 15/231 |
| 2016/0015236 | A1 * | 1/2016 | Gold | A47L 11/4047 15/228 |
| 2017/0181595 | A1 | 6/2017 | Hoying | |

* cited by examiner

FLOOR CLEANING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for more efficient cleaning of floors.

BRIEF SUMMARY OF THE INVENTION

An embodiment of the disclosure meets the needs presented above by generally comprising a rod and a plate. The plate is pivotally coupled to a lower end of the rod. A ridge is coupled to and extends from a bottom face of the plate. The ridge extends between opposing side edges of the plate. A plurality of couplers is coupled to the plate. Each coupler is configured to couple to a cloth proximate to a perimeter of the cloth so that the cloth is removably coupled to the plate. The cloth is positioned over the ridge and the bottom face of the plate. A user is positioned to grasp the rod and urge the cloth across a surface to clean the surface. Corner edges of the ridge provide increased contact between the cloth and the surface for more efficient cleaning of the surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
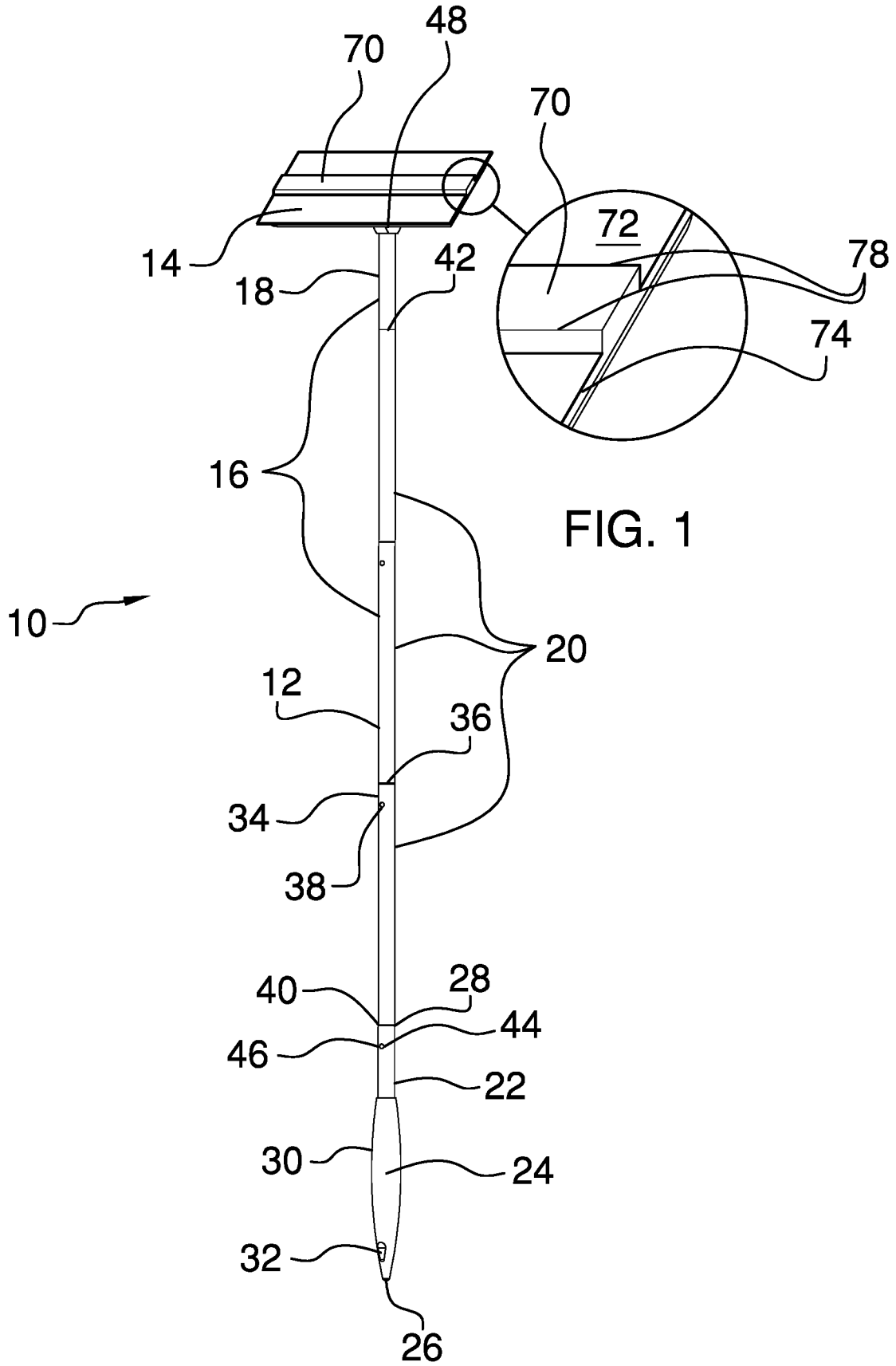
FIG. 1 is an isometric perspective view of a floor cleaning device according to an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the floor cleaning device 10 generally comprises a rod 12 and a plate 14. The rod 12 comprises a plurality of segments 16, as shown in FIG. 1. The segments 16 are selectively interconnectable so that the rod 12 is length adjustable. The plurality of segments 16 comprises a lower segment 18, a plurality of medial segments 20, and an upper segment 22. The plurality of medial segments 20 comprises three medial segments 20. The rod 12 is circularly shaped when viewed longitudinally.

A protrusion 24 extends radially from the upper segment 22, as shown in FIG. 1. The protrusion 24 extends from an upper endpoint 26 of the upper segment 22 toward a lower endpoint 28 of the upper segment 22. The protrusion 24 is configured to facilitate grasping of the rod 12 in a hand of a user. The protrusion 24 is circumferentially larger proximate to a midpoint 30 of the protrusion 24 so that the protrusion 24 tapers toward the upper endpoint 26 and the lower endpoint 28 of the upper segment 22.

An orifice 32 is positioned in the protrusion 24 proximate to the upper endpoint 26 of the upper segment 22. The orifice 32 is configured to selectively insert a connector, such as a hook, that is coupled to a substrate, such as a wall in a closet, to couple the rod 12 to the substrate.

A plurality of first fasteners 34 is coupled singly proximate to a lower terminus 36 of each of the medial segments 20 and the lower endpoint 28 of the upper segment 22, as shown in FIG. 1. A plurality of second fasteners 38 is coupled singly proximate to an upper terminus 40 of each of the medial segments 20 and an upper limit 42 of the lower segment 18. The second fasteners 38 are complementary to the first fasteners 34. Each second fastener 38 is positioned to selectively couple to a respective first fastener 34 to linearly couple the plurality of segments 16.

Each second fastener 38 comprises a pin 44. The pin 44 is spring loaded. Each first fastener 34 comprises a hole 46. Each hole 46 is positioned to selectively insert a respective pin 44 to linearly couple the plurality of segments 16.

Figure 4:
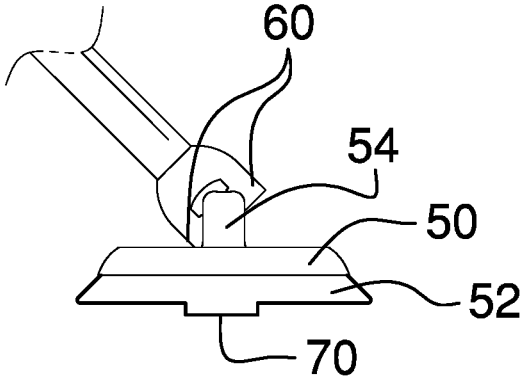
FIG. 4 is a side view of an embodiment of the disclosure.
Figure 5:
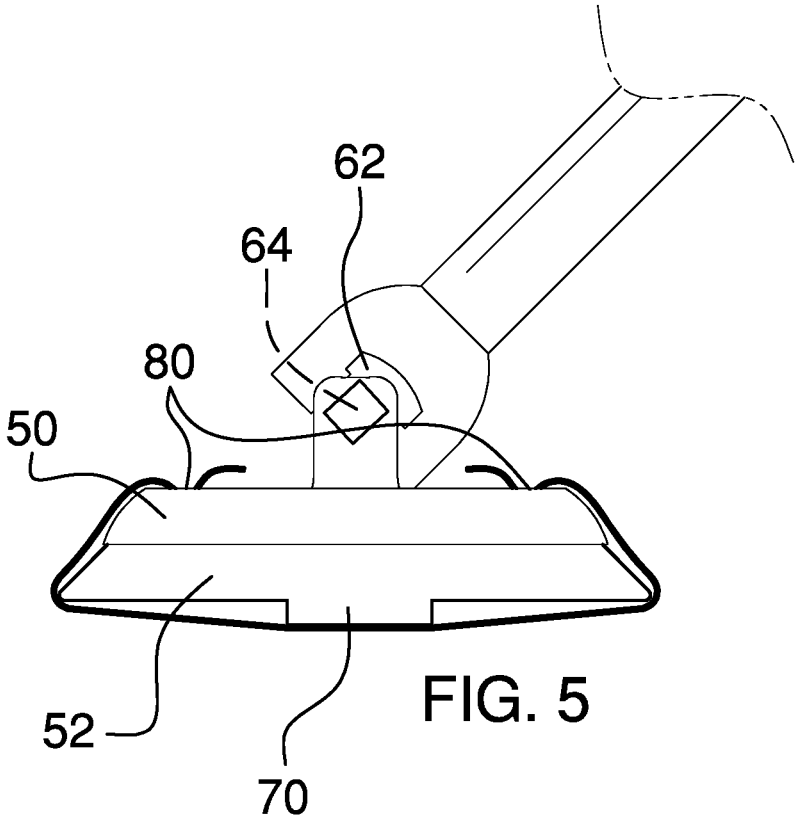
FIG. 5 is an in-use view of an embodiment of the disclosure.

The plate 14 is pivotally coupled to a lower end 48 of the rod 12, as shown in FIGS. 4 and 5. The plate 14 comprises an upper layer 50 and a lower layer 52. The lower layer 52 is removably couplable to the upper layer 50. The upper layer 50 is rigid, comprising hardened plastic, aluminum, or the like. The lower layer 52 is resilient, comprising silicone, rubber, or the like. The plate 14 is substantially rectangularly shaped.

Figure 3:
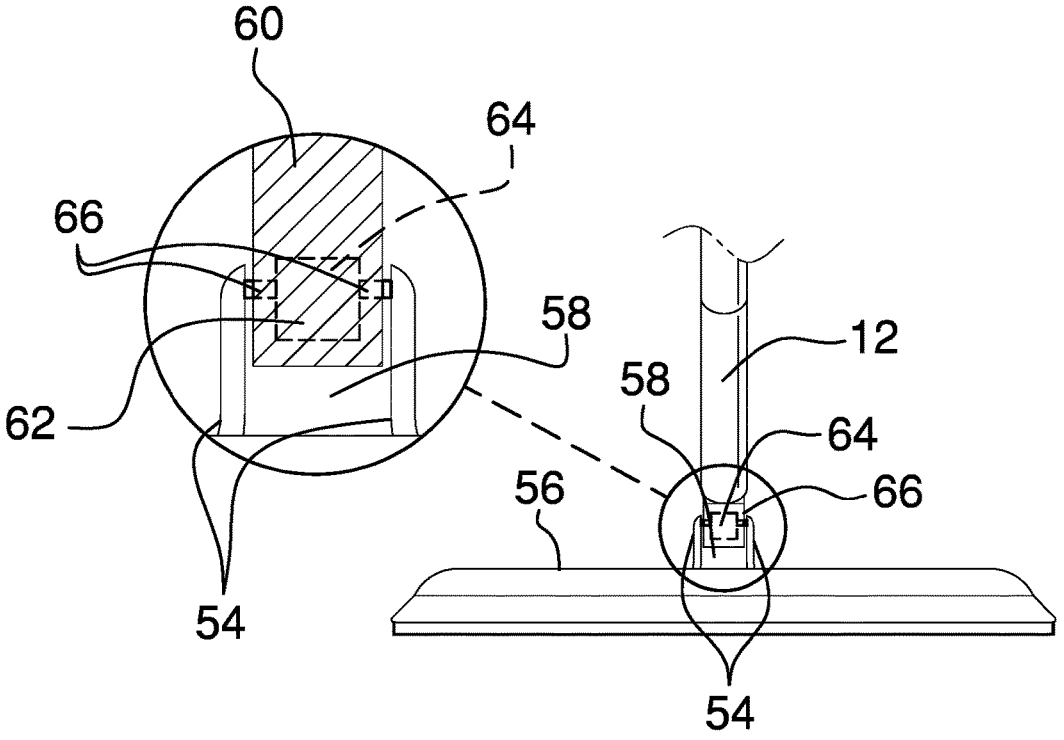
FIG. 3 is a front view of an embodiment of the disclosure.

A pair of first tabs 54 is coupled to and extends from a top face 56 of the plate 14 to define a first slot 58, as shown in FIG. 3. The pair of first tabs 54 is centrally positioned on the top face 56. A pair of second tabs 60 is coupled to and extends from the lower end 48 of the rod 12 to define a second slot 62, as shown in FIG. 4. A block 64 is positioned in the first slot 58 and the second slot 62. The block 64 has opposing first sides 66 and opposing second sides 68. Each opposing first side 66 is rotationally coupled to a respective first tab 54. Each opposing second side 68 is rotationally coupled to a respective second tab 60 so that the rod 12 is pivotally is coupled to the plate 14. The user is positioned to pivot the rod 12 transversely from the plate 14 toward either of opposing longitudinal edges 76 and either of opposing side edges 74 of the plate 14.

Figure 2:
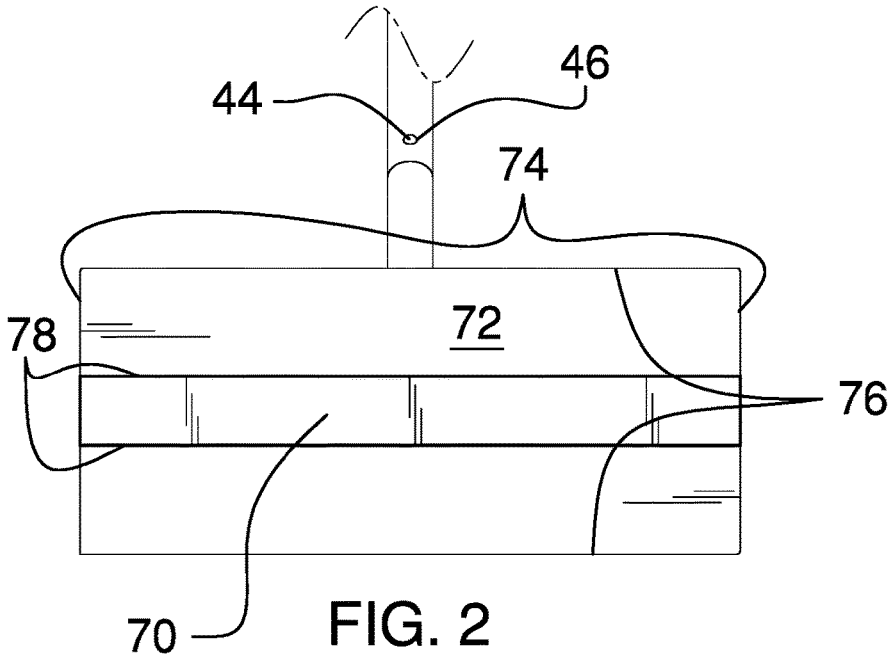
FIG. 2 is a bottom view of an embodiment of the disclosure.

A ridge 70 is coupled to and extends from a bottom face 72 of the plate 14, as shown in FIG. 2. The ridge 70 extends between the opposing side edges 74 of the plate 14. The ridge 70 is positioned substantially equally distant from the opposing longitudinal edges 76 of the plate 14. The ridge 70 is resilient, comprising silicone, rubber, or the like. The ridge 70 is substantially rectangularly shaped when viewed from a respective opposing side edge 74 of the plate 14, as shown in FIG. 4. The ridge 70 is integral to the lower layer 52 of the plate 14. The ridge 70 extends from 2.50 to 8.00 millimeters from the bottom face 72. The ridge 70 extends 3.18 millimeters from the bottom face 72. Corner edges 78 of the ridge 70 are separated by from 0.50 to 4.00 centimeters. The corner edges 78 of the ridge 70 are separated by 2.54 centimeters.

A plurality of couplers 80 is coupled to the plate 14, as shown in FIG. 5. Each coupler 80 is configured to couple to a cloth proximate to a perimeter of the cloth so that the cloth is removably coupled to the plate 14. The cloth is positioned over the ridge 70 and the bottom face 72 of the plate 14, as shown in FIG. 5. The user is positioned to grasp the rod 12 and urge the cloth across a surface, such as a floor, to clean the surface. The corner edges 78 of the ridge 70 provide increased contact between the cloth and the surface, leading to more efficient cleaning of the surface.

In use, the cloth is coupled to the plate 14 so that the cloth is positioned over the ridge 70 and the bottom face 72 of the plate 14. The user grasps the rod 12 and urges the cloth across the surface to clean the surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A floor cleaning device comprising:

a rod, the rod comprising a plurality of segments, the segments being selectively interconnectable such that the rod is length adjustable, the plurality of segments comprising a lower segment, a plurality of medial segments, and an upper segment, the plurality of medial segments comprising three medial segments, the rod being circularly shaped when viewed longitudinally;

a protrusion extending radially from the upper segment, the protrusion extending from an upper endpoint of the upper segment toward a lower endpoint of the upper segment wherein the protrusion is configured for facilitating grasping of the rod in a hand of a user, the protrusion being circumferentially larger proximate to a midpoint of the protrusion such that the protrusion tapers toward the upper endpoint and the lower endpoint of the upper segment;

an orifice positioned in the protrusion proximate to the upper endpoint of the upper segment wherein the orifice is configured for selectively inserting a connector coupled to a substrate for coupling the rod to the substrate;

a plurality of first fasteners, the first fasteners being coupled singly proximate to a lower terminus of each of the medial segments and the lower endpoint of the upper segment;

a plurality of second fasteners, the second fasteners being coupled singly proximate to an upper terminus of each of the medial segments and an upper limit of the lower segment, the second fasteners being complementary to the first fasteners wherein each second fastener is positioned for selectively coupling to a respective first fastener for linearly coupling the plurality of segments, each second fastener comprising a pin, the pin being spring loaded, each first fastener comprising a hole wherein each hole is positioned for selectively inserting a respective pin for linearly coupling the plurality of segments;

a plate pivotally coupled to a lower end of the rod, the plate comprising an upper layer and a lower layer, the upper layer being rigid, the lower layer being resilient, the plate being substantially rectangularly shaped, the lower layer being removably couplable to the upper layer;

a pair of first tabs coupled to and extending from a top face of the plate defining a first slot, the pair of first tabs being centrally positioned on the top face;

a pair of second tabs coupled to and extending from the lower end of the rod defining a second slot;

a block positioned in the first slot and the second slot, the block having opposing first sides and opposing second sides, each opposing first side being rotationally coupled to a respective first tab, each opposing second side being rotationally coupled to a respective second tab such that the rod is pivotally coupled to the plate;

a ridge coupled to and extending from a bottom face of the plate, the ridge extending between opposing side edges of the plate, the ridge being positioned substantially equally distant from opposing longitudinal edges of the plate, the ridge being resilient, the ridge being substantially rectangularly shaped when viewed from a respective opposing side edge of the plate, the ridge being integral to the lower layer of the plate, the ridge extending from 2.50 to 8.00 millimeters from the bottom face, the ridge extending 3.18 millimeters from the bottom face, corner edges of the ridge being separated by from 0.50 to 4.00 centimeters, the corner edges of the ridge being separated by 2.54 centimeters; and a plurality of couplers coupled to the plate, the couplers being configured for coupling to a cloth wherein each coupler is configured for coupling to the cloth proximate to a perimeter of the cloth such that the cloth is removably coupled to the plate and positioned over the ridge and the bottom face of the plate positioning the user for grasping the rod and urging the cloth across a surface for cleaning the surface wherein the corner edges of the ridge provides increased contact between the cloth and the surface.

* * * * *